US007916883B2

(12) United States Patent
Crook

(10) Patent No.: US 7,916,883 B2
(45) Date of Patent: Mar. 29, 2011

(54) HEARING AID WITH BATTERY DOOR

(75) Inventor: Ben Crook, Berne (CH)

(73) Assignee: Bernafon AG, Berne (CH)

( * ) Notice: Subject to any disclaimer, the term of this patent is extended or adjusted under 35 U.S.C. 154(b) by 1178 days.

(21) Appl. No.: 11/377,642

(22) Filed: Mar. 17, 2006

(65) Prior Publication Data

US 2007/0081684 A1 Apr. 12, 2007

(30) Foreign Application Priority Data

Oct. 11, 2005 (EP) ..... 05109405

(51) Int. Cl.
*H04R 25/00* (2006.01)

(52) U.S. Cl. ..... 381/322; 381/323

(58) Field of Classification Search ..... 381/322
See application file for complete search history.

(56) References Cited

U.S. PATENT DOCUMENTS

| | | | | |
|---|---|---|---|---|
| 5,386,476 | A * | 1/1995 | Bisgaard et al. | 381/323 |
| 6,585,075 | B1 * | 7/2003 | Gauthier | 181/135 |
| 6,831,988 | B2 * | 12/2004 | Vonlanthen | 381/323 |

FOREIGN PATENT DOCUMENTS

| | | | |
|---|---|---|---|
| EP | 0674465 | | 12/1994 |
| EP | 674465 | A1 * | 9/1995 |
| WO | 2004073351 | | 8/2004 |

* cited by examiner

*Primary Examiner* — Curtis Kuntz
*Assistant Examiner* — Matthew Eason
(74) *Attorney, Agent, or Firm* — Dykema Gossett PLLC

(57) ABSTRACT

The invention comprises a hearing aid with a casing and a battery with a battery access door in the casing. According to the invention:

the door is hingedly connected to the casing to allow a pivotal motion between the battery door and the casing, a flexible locking latch having a proximal end and a distal end is provided in either casing or battery door, the distal end of the flexible locking latch is arranged to flex along a path in order to release the battery door when an opening force is applied to the door, and an arrest pin is insertable in the moving path of the distal part of the flexible locking latch to block the movement of the latch when a child-resistant battery enclosure is desired.

11 Claims, 3 Drawing Sheets

HEARING AID WITH BATTERY DOOR

AREA OF THE INVENTION

The invention relates to a hearing aid with a battery door which is lockable such that it cannot be inadvertently opened.

BACKGROUND OF THE INVENTION

A child resist battery door is an important feature for a hearing aid which is to be used by young children. Also for hearing aid users who are mentally ill or retarded, it can be of importance that the battery door cannot be inadvertently opened. U.S. Pat. No. 5,386,476 disclose a prior art hearing aid with a locking device designed to avoid inadvertent opening of the battery compartment. The locking device comprises a displaceable pin, which can be maneuvered through an opening in the battery chamber by means of a pointed or thin object, e.g. a mandrel-shaped tool or the like. The pin is slidable and in one position it blocks the opening movement of the battery door and in a second position it is in-active and the door can be opened. Another prior art hearing aid with child proofing is described in WO 2004073351 A1. None of the prior art hearing aid constructions allow a simple and efficient construction with a safe prevention of inadvertent opening of the battery drawer.

SUMMARY OF THE INVENTION

In order to solve the above problems, a hearing aid according to the invention comprises a casing and a battery with a battery access door in the casing wherein:

- the door is hingedly connected to the casing to allow a pivotal motion between the battery door and the casing,
- a flexible locking latch and projection pair is arranged where the locking latch has a proximal end and a distal end,
- the distal end of the flexible locking latch is arranged to flex along a path in order to release the battery door when an opening force is applied to the door, and further,
- an arrest pin is insertable in the moving path of the distal part of the flexible locking latch to block the movement of the latch when a child-resistant battery door is desired.

When the battery door pivots with respect to the casing, the distal portion of the latch is forced to flex by the presence of the projection. In the flexing path of the latch an arrest pin is insertable such that the latch cannot flex and thus the battery door cannot be opened once the arrest pin is positioned in the path of the latch. The flexing latch and the arrangement of the arrest pin to be inserted in the path of the latch thus provides a very simple and very efficient way of securing the battery door against unauthorized opening of the battery door and access to the battery.

In an embodiment the arrest pin is turnable around its axis for placement in different angular positions, and has a part placed eccentrically with respect to the axis. The pin is arranged such that a first angular position places the eccentric part in the moving path of the locking latch and blocks the movement of the latch and such that a second angular position places the eccentric part outside the moving path of the latch. This arrangement provides a very simple child proofing function of the battery door. A simple turning action on the part of the arrest pin will either release or activate the child-proofing of the battery door.

In an embodiment the proximal part of the flexible latch is connected to the battery door, and the distal part is spaced apart from the battery door such that the moving path of the latch is defined by the space between the battery door and the distal part of the latch. The advantage here is that all the moving parts of the childproofing system are associated with the battery door, and may then easily be exchanged with the battery door. The battery door is usually a wear part and it may be exchanged once the wear reaches a certain level, and in this case the child-proofing part of the hearing aid will also be replaced. Also, it may happen that the child-proofing elements becomes worn to an extent where they are no longer working properly, and in this case they are easily exchanged by simply providing a new battery door with an arrest pin.

It is further advantageous when the arrest pin is insertable in the moving path of the latch member through a hole in the battery door, such that the hole defines a bearing for the turning motion of the pin.

In an embodiment the arrest pin comprises a head portion which is visible from the outside such that the head of the pin has a colour marking for indicating whether the hearing aid is a left ear or a right ear hearing aid. Such a colour marking of hearing aids is usually provided in order for the user to be better able to distinguish between the left and the right hand side hearing aid.

Advantageously the arrest pin comprises a cylindrical main body shaped with the head portion at one end and with the eccentric part at the opposite end thereof. The eccentric part may then easily be turned into the path of the latch or out of the flexing path thereof when the child-proofing is to be activated or de-activated respectively.

Preferably the eccentric part comprise a beam with two ends and is arranged to extend perpendicular to the centre axis of the arrest pin. When the pin is turned with the beam in parallel relationship with the latch, the latch may move, but when one of the ends of the beam is turned to point in the direction of the latch, the beam end will effectively block the movement of the latch. Hereby two different angular positions of the pin will result in activation of the child-resistance feature.

DESCRIPTION OF A PREFERRED EMBODIMENT

Figure 1:
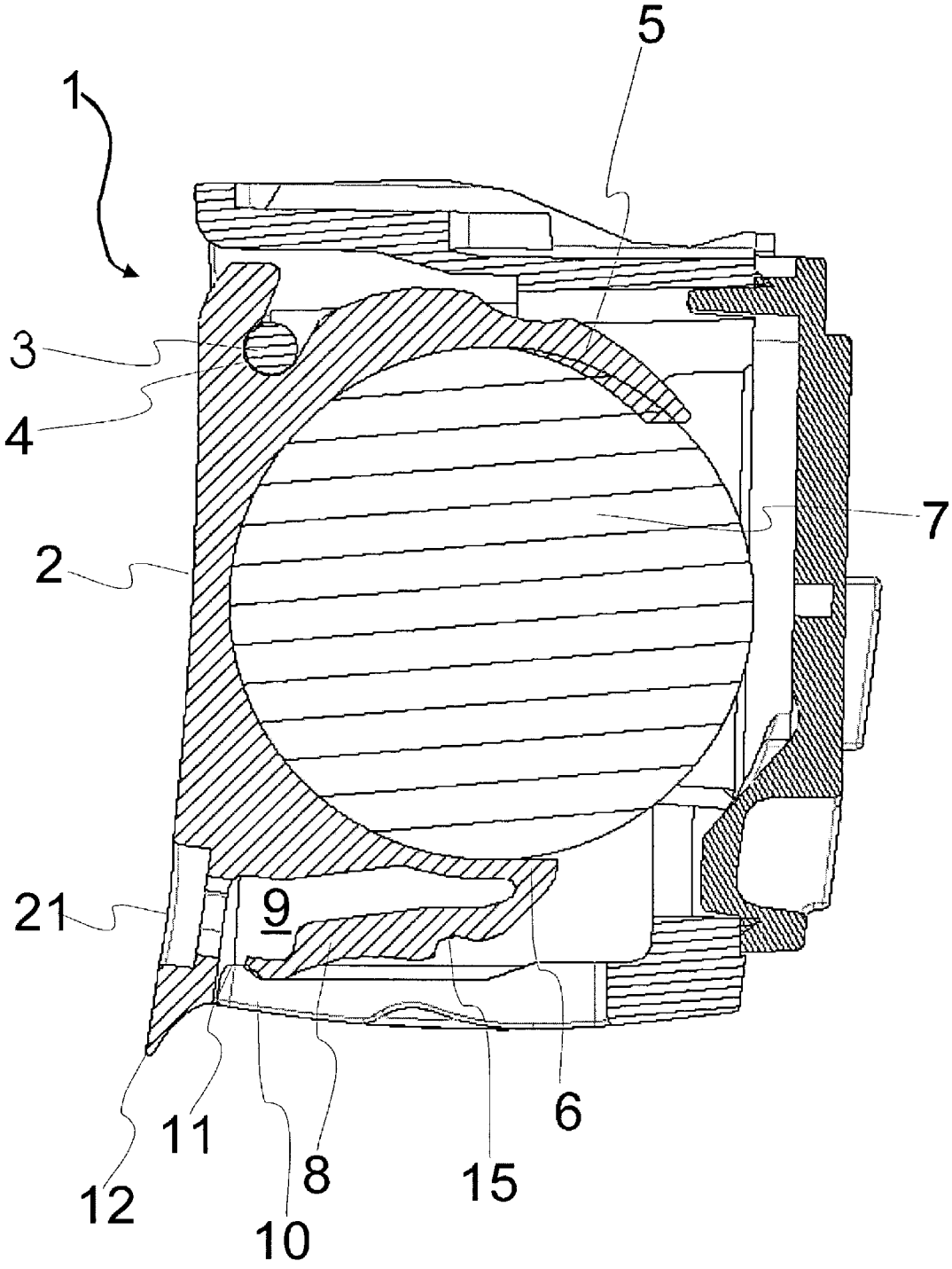
FIG. 1 shows a sectional view of a hearing aid according to the invention.

The battery door 2 shown in FIG. 1 is hinged to the hearing aid 1 by means of a hinge pin 3 and a bearing 4 made in the battery door 2. Only the parts of the hearing aid 1 immediately adjacently to the battery door 2 are represented in the drawing. As can further be seen in FIG. 1, the bearing 4 is open to one side, such that it may be snapped on to the hinge pin 3. In the embodiment shown, the battery door 2 also comprises two holding arms 5, 6, shaped to embrace and hold a battery 7. The one holding arm 5 is shaped adjacent to the bearing 4 and the other holding arm 6 is provided adjacent to the back-end of the hearing aid 1 when the battery door 2 is mounted and closed. When the battery door 2 is closed, connectors touch the negative and positive poles of the battery 7 in order to draw electric current for powering the hearing aid 1.

From the outer end of the holding arm 6 a flexible latch 8 extends such that a v-shaped space 9 is provided between the holding arm 6 and the latch 8. At the back wall 10 of the hearing aid 1 a protrusion 11 is provided, such that when the battery door 2 is rotated around hinge pin 3 in order to move from closed position as shown in FIG. 1 to an open position, the latch 8 will have to swing along a path in the v-shaped space 9. In this way the latch 8 will keep the battery door 2 closed and the opening movement can only be provided by exerting a force at a tap portion 12 which will overcome the resilience against bending of the latch 8.

In the shown embodiment the protrusion 11 is provided at the back wall 10 of the hearing aid, but the latch 8 may have a protrusion and a corresponding recess in the back-wall may be provided. Also the latch could be formed integrally with the hearing aid casing part and not with the battery drawer part if for design reasons this is wished. In the shown embodiment the battery door is made of a resilient material wherein the latch 8 is easily dimensioned to provide the desired spring action. In the shown embodiment the latch 8 is placed at the rear end of the hearing aid 1, but this is a design option as the latch and the hinge may change places, without departing from the general idea of the invention.

Figure 2:
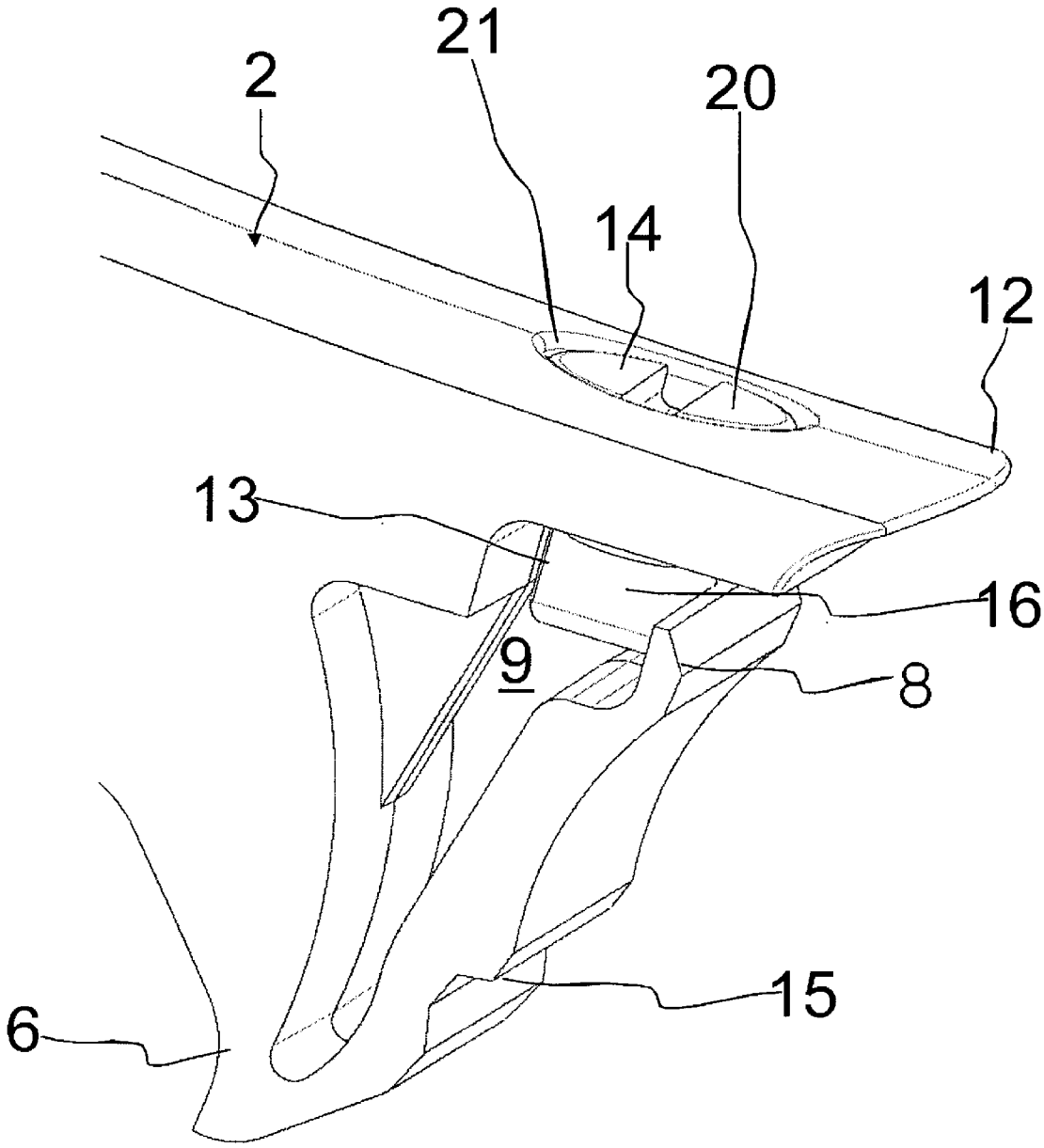
FIG. 2 is a perspective view of a battery door with an arrest pin in the active position.

In FIG. 2 the arrest pin 20 is shown inserted in a hole 21 in the battery door 2. The eccentric part 13 of the pin 20 is placed such that it blocks the movement of the latch 8 in the v-shaped space 9. As further seen in FIG. 2, the eccentric part 13 comprise an end part 13 of a beam 16 whereby the other end of the beam 16 is a further eccentric part 13*a* (best seen in FIG. 3), and following this the arrest pin 20 will be active in two angular positions. Further, when activated the beam 16 will act as a wedge where the eccentric parts or ends of the beam 13 and 13*a* together with the beam 16 extending between the two and fills the space 9 between the latch 8 and the holding arm 6 as best seen in FIG. 2.

Figure 3:
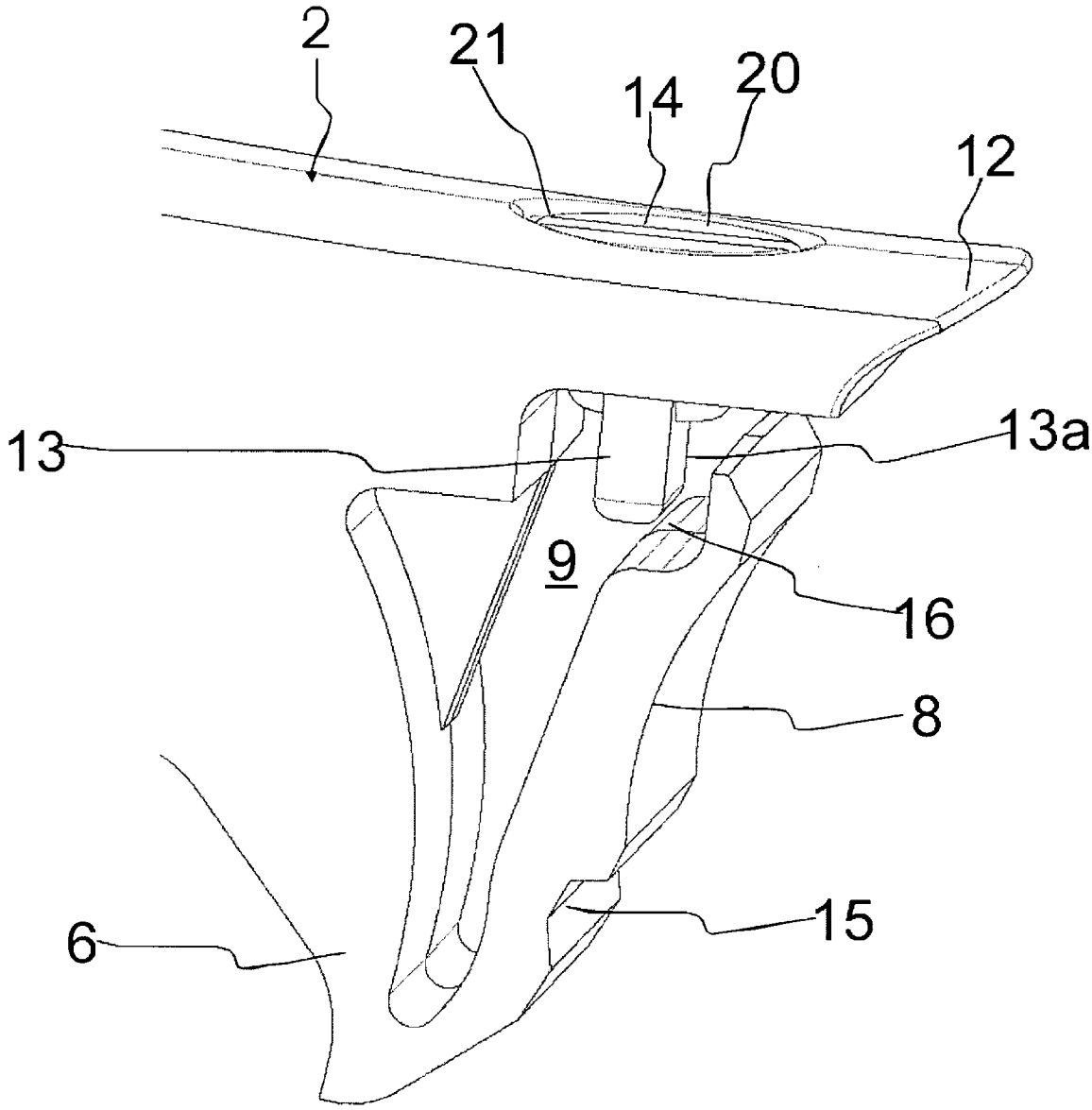
FIG. 3 is a perspective view of a battery door with an arrest pin in in-active position.

In FIG. 3 the arrest pin 20 is shown in a position where it is turned 90° with respect to the position in which it is shown in FIG. 2. In this position the latch 8 is free to move in the direction of the holding arm 6, and as can be seen from FIG. 1 this movement is necessary to open or close the battery drawer 2.

As seen in FIG. 2 the arrest pin 20 is inserted into the position through a hole 21 in the battery door 2, and the head portion 14 of the arrest pin 20 will be visible from outside the hearing aid and following this at least the head portion 14 is made with a colour for indicating whether the hearing aid 1 is for the right or for the left ear.

In order to turn the pin 20 a slot is provided in the head portion 14, such that the pin 20 may be turned by insertion of a small screw driver in the slot.

As seen in the figures a notch 15 is provided at the proximal end of the latch 8 such that the battery door may be arrested in a partially opened state when the protrusion 11 is caught in the notch 15 during opening or closing movement of the battery door 2. The partially opened state is useful in that in this state the battery 7 is not in connection with the terminals, and no current is drawn from the battery in this state. At the same time the battery 7 is safely contained within the hearing aid and it is easy to fully close the battery door 2 once normal operation is desired.

The invention claimed is:

1. A hearing aid comprising a casing and a battery with a battery access door in the casing wherein:

the door is hingedly connected to the casing to allow a pivotal motion between the battery door and the casing, a flexible locking latch and a protrusion is arranged where the locking latch has a proximal end and a distal end, the distal end of the flexible locking latch is arranged to flex along a path between the battery door and the casing in order to release the battery door when an opening force is applied to the door, an arrest pin is insertable in the flexing path of the distal part of the flexible locking latch to block the movement of the latch when a child-resistent battery enclosure is desired.

2. The hearing aid as claimed in claim 1, wherein the arrest pin is turnable around its axis for placement in different angular positions, and has a part placed eccentrically with respect to the axis, whereby a first angular position places the eccentric part in the moving path of the locking latch and blocks the movement of the latch and where a second angular position places the eccentric part outside the moving path of the latch.

3. The hearing aid as claimed in claim 1, wherein the proximal part of the flexible latch is connected to the battery door, and the distal part is spaced apart from the battery door such that the moving path of the latch is defined by the space between the battery door and the distal part of the latch.

4. The hearing aid as claimed in claim 3, wherein the arrest pin is insertable in the moving path of the latch member through a hole in the battery door, whereby the hole defines a bearing for the turning motion of the pin.

5. The hearing aid as claimed in claim 4, wherein the arrest pin comprises a head portion which is visible from the outside and whereby the head of the pin has a colour marking for indicating whether the hearing aid is a left ear or a right ear hearing aid.

6. The hearing aid as claimed in claim 5, wherein the arrest pin comprises a cylindrical main body shaped with the head portion at one end and with the eccentric part at the opposite end thereof.

7. The hearing aid as claimed in claim 6, wherein the eccentric part comprise a beam with two ends and arranged to extend perpendicular to the centre axis of the arrest pin.

8. A hearing aid which comprises:

a casing which defines a back wall and an opening to a battery compartment formed in part by said back wall, and a battery door which is pivotally connected at one end to said casing to cover or uncover said opening and includes means for supporting a battery, a flexible locking latch which can lock said battery door in a position covering said opening, or when flexed along a flex path between the battery door and the casing by an opening force applied to the battery door, will pivot relative to said casing to uncover said opening, and an arrest pin which is mounted on said battery door and extends into said flex path to block flexing of said locking latch and prevent pivoting of said battery door relative to said casing.

9. The hearing aid as claimed in claim 8, wherein said casing includes a hinge pin around which said battery cover can rotate.

10. The hearing aid as claimed in claim 8, wherein said means for supporting a battery comprise two opposed curved arms, and wherein said flexible locking latch is connected at a proximal end to one of said curved arms.

11. The hearing aid as claimed in claim 10, wherein said back wall defines a first projection which extends into said battery compartment and a distal end of said flexible locking latch can abut said first projection.

* * * * *